US012630779B2

(12) United States Patent
Rock

(10) Patent No.: US 12,630,779 B2
(45) Date of Patent: May 19, 2026

(54) TRANSMISSION LUBRICANTS CONTAINING MOLYBDENUM

(71) Applicant: AFTON CHEMICAL CORPORATION, Richmond, VA (US)

(72) Inventor: Bryan Rock, North Chesterfield, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 17/812,713

(22) Filed: Jul. 14, 2022

(65) Prior Publication Data

US 2024/0026243 A1 Jan. 25, 2024

(51) Int. Cl.

| | |
|---|---|
| ***C10M 159/24*** | (2006.01) |
| ***C10M 133/16*** | (2006.01) |
| ***C10M 135/32*** | (2006.01) |
| ***C10M 137/10*** | (2006.01) |
| ***C10M 169/04*** | (2006.01) |
| ***C10N 10/04*** | (2006.01) |
| ***C10N 10/12*** | (2006.01) |
| ***C10N 20/02*** | (2006.01) |
| ***C10N 30/00*** | (2006.01) |
| ***C10N 30/04*** | (2006.01) |
| ***C10N 40/04*** | (2006.01) |

(52) U.S. Cl.

CPC ..... *C10M 159/24* (2013.01); *C10M 133/16* (2013.01); *C10M 135/32* (2013.01); *C10M 137/10* (2013.01); *C10M 169/04* (2013.01); *C10M 2215/28* (2013.01); *C10M 2219/046* (2013.01); *C10M 2221/00* (2013.01); *C10M 2223/045* (2013.01); *C10N 2010/04* (2013.01); *C10N 2010/12* (2013.01); *C10N 2020/02* (2013.01); *C10N 2030/04* (2013.01); *C10N 2030/52* (2020.05); *C10N 2040/042* (2020.05); *C10N 2040/044* (2020.05); *C10N 2040/045* (2020.05)

(58) Field of Classification Search

CPC ..... C10M 133/16; C10M 135/52; C10M 137/10; C10M 159/24; C10M 169/04; C10M 2215/28; C10M 2219/046; C10M 2221/00; C10M 2223/045; C10N 2010/04; C10N 2010/12; C10N 2020/02; C10N 2030/04; C10N 2030/52; C10N 2040/042; C10N 2040/044; C10N 2040/045

See application file for complete search history.

(56) References Cited

U.S. PATENT DOCUMENTS

| | | | |
|---|---|---|---|
| 3,178,663 | A | 4/1965 | Kahn |
| 3,185,647 | A | 5/1965 | Anderson et al. |
| 3,189,544 | A | 6/1965 | Ratner et al. |
| 3,256,185 | A | 6/1966 | LeSuer |
| 3,278,550 | A | 10/1966 | Norman et al. |
| 3,312,619 | A | 4/1967 | Vineyard |
| 3,366,569 | A | 1/1968 | Norman et al. |
| 3,390,086 | A | 6/1968 | O'Halloran |
| 3,403,102 | A | 9/1968 | LeSuer |
| 3,458,530 | A | 7/1969 | Siegel et al. |
| 3,470,098 | A | 9/1969 | O'Halloran |
| 3,502,677 | A | 3/1970 | LeSuer |
| 3,519,564 | A | 7/1970 | Vogel |
| 3,546,243 | A | 12/1970 | Coupland |
| 3,573,205 | A | 3/1971 | Lowe et al. |
| 3,634,515 | A | 1/1972 | Piasek et al. |
| 3,649,229 | A | 3/1972 | Otto |
| 3,708,522 | A | 1/1973 | LeSuer |
| 3,749,695 | A | 7/1973 | Vries |
| 3,859,318 | A | 1/1975 | Lesuer |
| 3,865,740 | A | 2/1975 | Goldschmidt |
| 3,865,813 | A | 2/1975 | Gergel |
| 3,954,639 | A | 5/1976 | Liston |
| 4,152,499 | A | 5/1979 | Boerzel et al. |
| 4,234,435 | A | 11/1980 | Meinhardt et al. |
| 4,259,194 | A | 3/1981 | deVries et al. |
| 4,259,195 | A | 3/1981 | King et al. |
| 4,261,843 | A | 4/1981 | King et al. |
| 4,263,152 | A | 4/1981 | King et al. |
| 4,265,773 | A | 5/1981 | deVries et al. |
| 4,272,387 | A | 6/1981 | King et al. |
| 4,283,295 | A | 8/1981 | deVries et al. |
| 4,285,822 | A | 8/1981 | deVries et al. |

(Continued)

FOREIGN PATENT DOCUMENTS

| | | | |
|---|---|---|---|
| EP | 2789679 | A1 | 10/2014 |
| GB | 1065595 | A | 4/1967 |

(Continued)

OTHER PUBLICATIONS

Caterpillar Inc, "Tansmission and Drive Train Fluid Requirements." Specification TO-4 (Jun. 23, 2005): 1-44.

*Primary Examiner* — James C Goloboy

(74) *Attorney, Agent, or Firm* — Mendelsohn Dunleavy P.C.; Garth Dahlen; Kevin J. Dunleavy

(57) ABSTRACT

The disclosure relates to methods of operating transmissions and for providing bearing pitting protection and a passing static friction performance according to Caterpillar TO-4 SEQ 1221 in a transmission including lubricating the transmission with a transmission fluid composition comprising:

greater than 50 wt. % of a base oil of lubricating viscosity;

an amount of one or more overbased calcium sulfonate detergent(s) to provide from about 2000 ppm to about 5000 ppm of calcium;

an amount of one or more zinc dialkyl dithiophosphate compound(s) to provide from about 700 ppm to about 1500 ppm of zinc; and an amount of one or more molybdenum-containing compound(s) to provide from about 5 ppmw to about 300 ppmw molybdenum, and the one or more molybdenum-containing compound(s) is selected from the group consisting of molybdenum dithiocarbamates, molybdenum phosphorodithioates, organomolybdenum complexes, molybdenum dialkyldithiophosphates and mixtures thereof. The disclosure also relates to the compositions used in these methods.

10 Claims, No Drawings

(56) References Cited

U.S. PATENT DOCUMENTS

| | | | | |
|---|---|---|---|---|
| 4,379,064 | A | 4/1983 | Cengel et al. | |
| 4,482,464 | A | 11/1984 | Karol et al. | |
| 4,521,318 | A | 6/1985 | Karol | |
| 4,554,086 | A | 11/1985 | Karol et al. | |
| 4,579,675 | A | 4/1986 | Sawicki et al. | |
| 4,612,132 | A | 9/1986 | Wollenberg | |
| 4,614,522 | A | 9/1986 | Buckley | |
| 4,614,603 | A | 9/1986 | Wollenberg | |
| 4,617,137 | A | 10/1986 | Plavac | |
| 4,617,138 | A | 10/1986 | Wollenberg | |
| 4,636,322 | A | 1/1987 | Nalesnik | |
| 4,645,515 | A | 2/1987 | Wollenberg | |
| 4,646,860 | A | 3/1987 | Owens et al. | |
| 4,647,390 | A | 3/1987 | Buckley, III et al. | |
| 4,648,886 | A | 3/1987 | Buckley, III et al. | |
| 4,648,980 | A | 3/1987 | Erdman | |
| 4,652,387 | A | 3/1987 | Andress, Jr. et al. | |
| 4,663,062 | A | 5/1987 | Wollenberg | |
| 4,663,064 | A | 5/1987 | Nalesnik et al. | |
| 4,666,459 | A | 5/1987 | Wollenberg | |
| 4,666,460 | A | 5/1987 | Wollenberg | |
| 4,668,246 | A | 5/1987 | Wollenberg | |
| 4,670,170 | A | 6/1987 | Wollenberg | |
| 4,699,724 | A | 10/1987 | Nalesnik et al. | |
| 4,713,189 | A | 12/1987 | Nalesnik et al. | |
| 4,713,191 | A | 12/1987 | Nalesnik | |
| 4,857,214 | A | 8/1989 | Papay et al. | |
| 4,943,672 | A | 7/1990 | Hamner et al. | |
| 4,948,386 | A | 8/1990 | Sung et al. | |
| 4,963,275 | A | 10/1990 | Gutierrez et al. | |
| 4,963,278 | A | 10/1990 | Blain et al. | |
| 4,971,598 | A | 11/1990 | Andress et al. | |
| 4,971,711 | A | 11/1990 | Lundberg et al. | |
| 4,973,412 | A | 11/1990 | Migdal et al. | |
| 4,981,492 | A | 1/1991 | Blain et al. | |
| 5,026,495 | A | 6/1991 | Emert et al. | |
| 5,030,249 | A | 7/1991 | Herbstman et al. | |
| 5,039,307 | A | 8/1991 | Herbstman et al. | |
| 5,075,383 | A | 12/1991 | Migdal et al. | |
| 5,112,506 | A * | 5/1992 | Marsh | C07G 99/0024 508/390 |
| 5,241,003 | A | 8/1993 | Degonia et al. | |
| 5,334,321 | A | 8/1994 | Harrison et al. | |
| 5,344,579 | A | 9/1994 | Ohtani et al. | |
| 5,650,381 | A | 7/1997 | Gatto et al. | |
| 5,739,355 | A | 4/1998 | Gateau et al. | |
| 5,882,505 | A | 3/1999 | Wittenbrink et al. | |
| 5,888,945 | A | 3/1999 | Stiefel et al. | |
| 6,010,987 | A | 1/2000 | Stiefel et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,107,257 | A | 8/2000 | Valcho et al. | |
| 6,165,949 | A | 12/2000 | Berlowitz et al. | |
| 6,180,575 | B1 | 1/2001 | Nipe | |
| RE37,363 | E | 9/2001 | Gatto et al. | |
| 6,723,685 | B2 | 4/2004 | Hartley et al. | |
| RE38,929 | E | 1/2006 | Gatto et al. | |
| 7,214,649 | B2 | 5/2007 | Loper et al. | |
| 7,253,231 | B2 | 8/2007 | Devlin et al. | |
| 7,368,596 | B2 | 5/2008 | Thomson et al. | |
| RE40,595 | E | 12/2008 | Gatto et al. | |
| 7,485,603 | B2 | 2/2009 | Bera et al. | |
| 7,645,726 | B2 | 1/2010 | Loper | |
| 7,732,390 | B2 | 6/2010 | Kadkhodayan et al. | |
| 7,786,057 | B2 | 8/2010 | Bera et al. | |
| 7,897,696 | B2 | 3/2011 | Huang et al. | |
| 8,048,831 | B2 | 11/2011 | Loper | |
| 8,076,275 | B2 | 12/2011 | Ruhe, Jr. et al. | |
| 10,023,824 | B2 * | 7/2018 | Bender | C10M 137/10 |
| 2004/0171500 | A1 * | 9/2004 | Morita | C10M 167/00 508/363 |
| 2012/0101017 | A1 | 4/2012 | Duggal | |
| 2019/0264124 | A1 * | 8/2019 | Narita | C10M 133/00 |
| 2020/0354647 | A1 * | 11/2020 | Schwaebisch | C10M 169/044 |

FOREIGN PATENT DOCUMENTS

| | | | |
|---|---|---|---|
| GB | 2140811 | A | 12/1984 |
| GB | 2440811 | A | 2/2008 |
| WO | 9406897 | A1 | 3/1994 |

* cited by examiner

TRANSMISSION LUBRICANTS CONTAINING MOLYBDENUM

FIELD OF THE INVENTION

The disclosure relates to transmission fluids containing a molybdenum-containing component in combination with a zinc dialkyldithiophosphate and a calcium detergent for lubrication of a transmission to provide bearing pitting protection while meeting friction requirements.

BACKGROUND

Lubricating compositions are used to prevent damage to machinery under operating conditions. In particular, under boundary lubricating conditions, a lubricant must act to minimize harmful metal-to-metal contact. Lubricant additive chemistry is useful at providing protection under boundary lubricating conditions but sometimes these additives adversely affect other performance characteristics. For example, a lubricant may be able to provide surface fatigue protection such as, such as by reducing pitting, but may fail to meet stringent requirements on friction performance.

In the early 1990s, Caterpillar Corporation introduced a set of transmission and drivetrain fluid requirements, designated as the "Caterpillar TO-4" specification (version Jun. 23, 2005), for use in Caterpillar's heavy vehicle machinery. Lubricant compositions which meet the requirements of the "Caterpillar TO-4" specification are considered to be suitable for off-road applications. All Caterpillar TO-4 lubricant compositions must comply with a number of standards including certain wear, viscometric and friction conditions as set out in the Caterpillar TO-4 specification. Many of the additives used in final drive and powershift transmission lubricants are multifunctional and there is often a conflict between properties, such as providing bearing pitting performance and while maintaining acceptable friction characteristics.

In particular, a Caterpillar TO-4 compliant lubricant composition has to fulfill specific requirements for the static friction properties of the lubricant composition. For example, crankcase lubricant compositions usually do not fulfill the requirements for the static friction properties according to the Caterpillar TO-4 specification since they contain friction modifiers. As such, use of molybdenum-containing friction modifiers is typically avoided in lubricants destined for off-road applications since such friction modifiers may lower the static friction to a level that no longer qualifies under the Caterpillar TO-4 specification.

There is a need to identify lubricant compositions suitable for addressing the bearing pitting problem while still meeting the static friction requirement of the Caterpillar TO-4 specification.

EP2789679 relates to lubricant compositions that meet the TO-4 specification describes and methods of lubricating off-road vehicles and/or machinery. These lubricants comprises at least one ashless component having the structure $P(=S)(SR^1)(OR^2)(OR^3)$ and a metal dialkyl dithiophosphate salt, such as zinc dialkyl dithiophosphate.

SUMMARY OF THE INVENTION

The present invention may be described by the following sentences.

1. In a first aspect, the present invention relates to a transmission fluid composition including: greater than 50 wt. % of a base oil of lubricating viscosity;

an amount of one or more overbased calcium sulfonate detergent(s) to provide from about 2000 ppm to about 5000 ppm of calcium to the transmission fluid composition;

an amount of one or more zinc dialkyl dithiophosphate compound(s) to provide from about 700 ppm to about 1500 ppm of zinc to the transmission fluid composition;

an amount of one or more molybdenum-containing compound(s) to provide from about 5 ppmw to about 300 ppmw molybdenum to the transmission fluid composition, wherein all amounts are based on a total weight of the transmission fluid composition and the one or more molybdenum-containing compound(s) is selected from the group consisting of molybdenum dithiocarbamates, molybdenum phosphorodithioates, organomolybdenum complexes, molybdenum dialkyldithiophosphates and mixtures thereof.

2. The composition of sentence 1, wherein the one or more molybdenum-containing compound(s) may be present in an amount to provide from about 10 ppmw to about 280 ppmw molybdenum, or from about 15 ppmw to about 240 ppmw molybdenum, or from about 25 ppmw to about 200 ppmw molybdenum to the transmission fluid composition, based on the total weight of the transmission fluid composition.
3. The composition of any one of sentences 1-2, wherein the one or more molybdenum-containing compound(s) may be present in an amount to provide from about 30 ppmw to about 120 ppmw molybdenum to the transmission fluid composition, based on the total weight of the transmission fluid composition.
4. The composition of any one of sentences 1-3, wherein the transmission fluid may meet the requirements of Caterpillar static friction test SEQ 1221.
5. The composition of any one of sentences 1-4, wherein the one or more zinc dialkyl dithiophosphate compound(s) may be derived from one or more primary alkyl alcohol(s) each having an alkyl group with 3 to 10 carbon atoms.
6. The composition of sentence 5, wherein the alkyl group of the one or more primary alkyl alcohol(s) may have branching at the beta carbon relative to the hydroxyl group.
7. The composition of any one of sentences 1-6, wherein the one or more zinc dialkyl dithiophosphate compound(s) may be present in an amount to provide from about 750 ppm to about 1400 ppm of zinc, or from about 800 ppm to about 1300 ppm of zinc, or from about 850 ppm to about 1200 ppm of zinc to the transmission fluid composition, based on the total weight of the transmission fluid composition.
8. The composition of any one of sentences 1-7, wherein the overbased calcium sulfonate detergent may have a total base number (TBN) of about 200 mg KOH/g or greater, or about 250 mg KOH/g or greater, or about 300 mg KOH/g or greater, or about 350 mg KOH/g or greater, or about 375 mg KOH/g or greater, or about 400 mg KOH/g or greater, as measured by the method of ASTM D-2896.
9. The composition of any one of sentences 1-8, wherein the molybdenum-containing compound(s) may be selected from molybdenum dithiocarbamates of the formula:

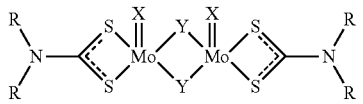

wherein Y and X are independently selected from oxygen and sulfur, each X and each Y may be the same or different, and R is selected from a linear or branched alkyl group having 1 to 30 carbon atoms;

molybdenum dialkyl phosphorodithioates of the formula:

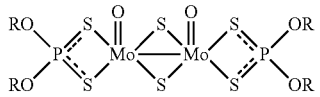

wherein R is a linear or branched alkyl group having 1 to 30 carbon atoms or R is an alkenyl group having 2 to 30 carbon atoms, and each R group may be the same or different;

molybdenum dialkyldithiophosphates of the formula:

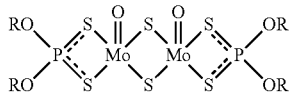

wherein R is a linear or branched alkyl group having 1 to 20 carbon atoms, and each R group may be the same or different; and molybdenum succinimide complexes or organomolybdenum complexes of organic amides, and mixtures of any two or more of the foregoing compounds and complexes.

10. The composition of any one of sentences 1-9, may further comprise an amount of one or more dispersant (s), to provide from about 10 ppm to about 200 ppm of nitrogen to the transmission fluid composition, based on the total weight of the transmission fluid composition.

11. The composition of sentence 10, wherein the one or more dispersant(s) may include a succinimide dispersant.

12. The composition of any one of sentences 10-11, wherein the dispersant may be present in an amount of less than 5.0 wt. %, or less than 3.0 wt. %, or less than 1.0 wt. %, based on the total weight of the transmission fluid composition.

13. In a second aspect, the present invention relates to a method of operating a transmission comprising lubricating said transmission with a transmission fluid composition comprising:

greater than 50 wt. % of a base oil of lubricating viscosity;

an amount of one or more overbased calcium sulfonate detergent(s) to provide from about 2000 to about 5000 ppm of calcium to the transmission fluid composition;

an amount of one or more zinc dialkyl dithiophosphate compound(s) to provide from about 700 to about 1500 ppm of zinc to the transmission fluid composition;

an amount of one or more molybdenum-containing compound(s) to provide from about 5 ppmw to about 300 ppmw molybdenum to the transmission fluid composition, wherein all amounts are based on a total weight of the transmission fluid composition and the one or more molybdenum-containing compound(s) is selected from the group consisting of molybdenum dithiocarbamate, molybdenum phosphorodithioate, organomolybdenum complex, and molybdenum dialkyldithiophosphate.

14. The method of sentence 13, wherein the one or more molybdenum-containing compound(s) is present in an amount to provide from about 10 ppmw to about 280 ppmw molybdenum, or from about 15 ppmw to about 240 ppmw molybdenum, or from about 25 ppmw to about 200 ppmw molybdenum to the transmission fluid composition, based on the total weight of the transmission fluid composition.

15. The method of any one of sentences 13-14, wherein the one or more molybdenum-containing compound(s) may be present in an amount to provide from about 30 ppmw to about 120 ppmw molybdenum to the transmission fluid composition, based on the total weight of the transmission fluid composition.

16. The method of any one of sentences 13-15, wherein the one or more zinc dialkyl dithiophosphate compound(s) may be derived from one or more primary alkyl alcohol(s) each having an alkyl group with 3 to 10 carbon atoms.

17. The method of sentence 16, wherein the alkyl group of the one or more primary alkyl alcohol(s) may have branching at the beta carbon relative to the hydroxyl group.

18. The method of any one of sentences 13-17, wherein the one or more zinc dialkyl dithiophosphate compound(s) may be present in an amount to provide from about 750 ppm to about 1400 ppm of zinc, or from about 800 ppm to about 1300 ppm of zinc, or from about 850 ppm to about 1200 ppm of zinc to the transmission fluid composition, based on the total weight of the transmission fluid composition.

19. The method of any one of sentences 13-18, wherein the overbased calcium sulfonate detergent may have a total base number (TBN) of about 200 mg KOH/g or greater, or about 250 mg KOH/g or greater, or about 300 mg KOH/g or greater, or about 350 mg KOH/g or greater, or about 375 mg KOH/g or greater, or about 400 mg KOH/g or greater, as measured by the method of ASTM D-2896.

20. The method of any one of sentences 13-19, wherein the molybdenum-containing compound(s) may be selected from molybdenum dithiocarbamates of the formula:

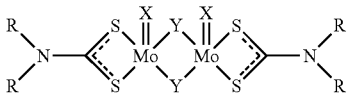

wherein Y and X are independently selected from oxygen and sulfur, each X and each Y may be the same or different, and R is selected from a linear or branched alkyl group having 1 to 30 carbon atoms;

molybdenum dialkyl phosphorodithioates of the formula:

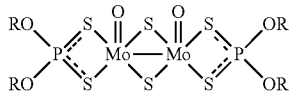

wherein R is a linear or branched alkyl group having 1 to 30 carbon atoms or R is an alkenyl group having 2 to 30 carbon atoms, and each R group may be the same or different;

molybdenum dialkyldithiophosphates of the formula:

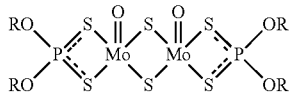

wherein R is a linear or branched alkyl group having 1 to 20 carbon atoms, and each R group may be the same or different; and molybdenum succinimide complexes or organomolybdenum complexes of organic amides, and mixtures of any two or more of the foregoing molybdenum compounds and complexes.

21. The method of any one of sentences 13-20, may further include an amount of one or more dispersant(s), to provide from about 10 ppm to about 200 ppm of nitrogen to the transmission fluid composition, based on the total weight of the transmission fluid composition.

22. The method of sentence 21, wherein the one or more dispersant(s) may include a succinimide dispersant.

23. The method of any one of sentences 21-22, wherein the dispersant may be present in an amount of less than 5.0 wt. %, or less than 3.0 wt. %, or less than 1.0 wt. %, based on the total weight of the transmission fluid composition.

24. In a third aspect, the present invention relates to a method for providing bearing pitting protection and passing static friction performance according to Caterpillar TO-4 SEQ 1221 in a transmission, comprising lubricating the transmission with a transmission fluid composition comprising:

greater than 50 wt. % of a base oil of lubricating viscosity;

an amount of one or more overbased calcium sulfonate detergent(s) to provide from about 2000 to about 5000 ppm of calcium to the transmission fluid composition;

an amount of one or more zinc dialkyl dithiophosphate compound(s) to provide from about 700 to about 1500 ppm of zinc to the transmission fluid composition;

an amount of one or more molybdenum-containing compound(s) to provide from about 5 ppmw to about 300 ppmw molybdenum to the transmission fluid composition, wherein all amounts are based on a total weight of the transmission fluid composition and the one or more molybdenum-containing compound(s) is selected from the group consisting of molybdenum dithiocarbamate, molybdenum phosphorodithioate, organomolybdenum complex, and molybdenum dialkyldithiophosphate.

25. The composition of any one of sentences 1-12, and the methods of any one of sentences 13-24, wherein the transmission fluid is formulated for use in off-road vehicles and/or heavy machinery.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "driveshaft lubricant," "driveline oil," "axle lubricant," "axle oil," "functional oil," "functional fluid", "functional lubricant," "driveshaft oil", "driveshaft lubricant," "differential oil," and "differential lubricant," are considered synonymous, fully interchangeable terminology referring to the finished lubrication product comprising a major amount of a base oil plus a minor amount of an additive composition.

As used herein, the terms "additive package," "additive concentrate," "additive composition," "functional oil additive package", "functional lubricant additive package," are considered synonymous, fully interchangeable terminology referring to the portion of the transmission fluid composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION OF THE INVENTION

Disclosed herein is a transmission fluid composition including:

- greater than 50 wt. % of a base oil of lubricating viscosity;
- an amount of one or moreoverbased calcium sulfonate detergent(s) sufficient to provide from about 2000 to about 5000 ppm of calcium to the transmission fluid composition;
- an amount of one or more zinc dialkyl dithiophosphate compound(s) sufficient to provide from about 700 to about 1500 ppm of zinc to the transmission fluid composition; and
- an amount of one or more molybdenum-containing compound(s) sufficient to provide from about 5 ppmw to about 300 ppmw molybdenum to the transmission fluid composition, wherein all amounts are based on a total weight of the transmission fluid composition and the one or more molybdenum-containing compound(s) is selected from the group consisting of molybdenum dithiocarbamate, molybdenum phosphorodithioate, organomolybdenum complex, and molybdenum dialkyldithiophosphate.

Also disclosed herein is a method for lubricating a transmission using the transmission fluid described above, as well as a method for reducing bearing pitting while pasting the Caterpillar TO-4 static friction test including a step of lubricating a transmission using the transmission fluid described above.

Base Oil

Base oils suitable for use in formulating transmission fluid compositions and driveline lubricants according to the disclosure may be selected from any of suitable synthetic or natural oils or mixtures thereof having a suitable lubricating viscosity. Natural oils may include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale may also be suitable. The base oil may have a viscosity of 2 to 15 cSt or, as a further example, 2 to 10 cSt at 100° C. Further, oil derived from a gas-to-liquid process is also suitable.

Suitable synthetic base oils may include alkyl esters of dicarboxylic acids, polyglycols and alcohols, poly-alpha-olefins, including polybutenes, alkyl benzenes, organic esters of phosphoric acids, and polysilicone oils. Synthetic oils include hydrocarbon oils such as polymerized and interpolymerized olefins (e.g., polybutylenes, polypropylenes, propylene isobutylene copolymers, etc.); poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and the derivatives, analogs and homologs thereof and the like.

Alkylene oxide polymers and interpolymers and derivatives thereof where the terminal hydroxyl groups have been modified by esterification, etherification, etc., constitute another class of known synthetic oils that may be used. Such oils are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1000, diphenyl ether of polyethylene glycol having a molecular weight of 500-1000, diethyl ether of polypropylene glycol having a molecular weight of 1000-1500, etc.) or mono- and polycarboxylic esters thereof, for example, the acetic acid esters, mixed $C_3$-$C_8$ fatty acid esters, or the $C_{13}$ oxo-acid diester of tetraethylene glycol.

Another class of synthetic oils that may be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di-(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Hence, the base oil used which may be used to make the transmission fluid compositions as described herein may be a single base oil or may be a mixture of two or more base oils. In particular, the one or more base oil(s) may desirably be selected from any of the base oils in Groups I-V as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

In one variation, in each of the foregoing embodiments, the base oil may be selected from a Group II base oil having at least 90% saturates, a Group III base oil having at least 90% saturates, a Group IV base oil, a Group V base oil or a mixture of two or more of these base oils. Alternatively, the base oil may be a Group III base oil, or a Group IV base oil, or a Group V base oil, or the base oil may be a mixture of two or more of a Group III base oil, a Group IV base oil and a Group V base oil.

The base oil may contain a minor or major amount of a poly-alpha-olefin (PAO). Typically, the poly-alpha-olefins are derived from monomers having from 4 to 30, or from 4 to 20, or from 6 to 16 carbon atoms. Examples of useful PAOs include those derived from octene, decene, mixtures thereof, and the like. PAOs may have a viscosity of from 2 to 15, or from 3 to 12, or from 4 to 8 cSt at 100° C. Examples of PAOs include 4 cSt at 100° C. poly-alpha-olefins, 6 cSt at 100° C. poly-alpha-olefins, and mixtures thereof. Mixtures of mineral oil with the foregoing poly-alpha-olefins may be used.

The base oil may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined, and rerefined oils, either natural or synthetic (as well as mixtures of two or more of any of these) of the type disclosed hereinabove can be used in the base oils. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The base oil may be combined with an additive composition as disclosed in embodiments herein to provide multi-vehicle transmission fluid compositions. Accordingly, the base oil may be present in the fluid composition described herein in an amount ranging from more than 30 wt. % to 95 wt. %, for example, from 40 wt. % to 90 wt. %, and more than 50 wt. % based on a total weight of the transmission fluid composition.

Molybdenum-Containing Component

The transmission fluid compositions described herein include one or more molybdenum-containing compounds. An oil-soluble molybdenum compound may have the functional performance of an antiwear agent, an antioxidant, a friction modifier, or mixtures of these functions. The oil-soluble molybdenum compounds include molybdenum dithiocarbamates, molybdenum dialkyl phosphorodithioates, molybdenum dialkyldithiophosphates, molybdenum dithiophosphinates, organomolybdenum complexes, amine salts of molybdenum compounds, acidic molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion.

In one embodiment the oil-soluble molybdenum compound is selected from molybdenum dithiocarbamates, molybdenum dialkyldithiophosphates, amine salts of molybdenum compounds, and mixtures of two or more of these compounds. In one embodiment the oil-soluble molybdenum compound is molybdenum dithiocarbamate.

The molybdenum dithiocarbamates of the present invention may be described by the following formula:

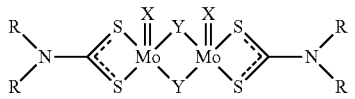

wherein Y and X are independently selected from oxygen and sulfur and each X and each Y may be the same or different. In some embodiments, Y is sulfur and X and oxygen. R is selected from a linear or branched alkyl group having 1 to 30 carbon atoms, or from about 2 to about 20 carbon atoms, or from about 3 carbon atoms to about 18 carbon atoms, or R is selected from an alkenyl group having 2 to 30 carbon atoms, or from about 2 to about 20 carbon atoms, or from about 3 carbon atoms to about 18 carbon atoms. wherein each R group may be the same or different.

Suitable examples of the molybdenum dialkyldithiocarbamates include molybdenum diethyldithiocarbamate, molybdenum dipropyldithiocarbamate, molybdenum di-n-butyldithio-carbamates, molybdenum dipentyldithiocarbamate, molybdenum dihexyldithiocarbamate, molybdenum dioctyldithiocarbamate, molybdenum didecyldithiocarbamate, molybdenum didodecyldithiocarbamate, molybdenum ditridecyldithiocarbamate, molybdenum (butylphenyl)dithiocarbamate, and molybdenum di(nonylphenyl)dithiocarbamate Trinuclear molybdenum compounds such as trinuclear molybdenum dialkyldithiocarbamates can also be employed. Such trinuclear molybdenum compounds are known in the art, as taught by U.S. Pat. Nos. 5,888,945 and 6,010,987, herein incorporated by reference for their disclosure of such trinuclear molybdenum compounds. Trinuclear molybdenum compounds that may be employed in the lubricant compositions include those having the formulas $Mo_3S_4(dtc)$ and $Mo_3S_7(dtc)_4$ and mixtures thereof wherein dtc represents independently selected diorganodithiocarbamate ligands containing independently selected organo groups and wherein the ligands have sufficient carbon atoms present among all the organo groups of the compound's ligands to render the compound soluble or dispersible in the base oil.

The molybdenum dialkyl phosphorodithioates of the present invention have the following formula:

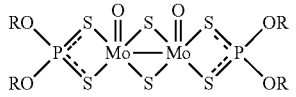

wherein R is a linear or branched alkyl group having 1 to 30 carbon atoms, or from about 2 to about 20 carbon atoms, or from about 3 carbon atoms to about 18 carbon atoms, or from about 4 carbon atoms to about 12 carbon atoms, or R is an alkenyl group having 2 to 30 carbon atoms, or from about 2 to about 20 carbon atoms, or from about 3 carbon atoms to about 18 carbon atoms, and each R group may be the same or different.

Examples of the molybdenum dialkyl phosphorodithioates include molybdenum diethyl phosphorodithioate, molybdenum dipropyl phosphorodithioate, molybdenum di-n-butyl phosphorodithioate, molybdenum dipentyl phosphorodithioate, molybdenum dihexyl phosphorodithioate, molybdenum dioctyl phosphorodithioate, molybdenum dodecyl phosphorodithioate, molybdenum didodecyl phosphorodithioate, molybdenum ditridecyl phosphorodithioate, molybdenum (butylphenyl) phosphorodithioate, molybdenum di(2-ethylhexyl) phosphorodithioate and molybdenum di(nonylphenyl) phosphorodithioate.

Examples of molybdenum dialkyldithiophosphates include those having the following formula:

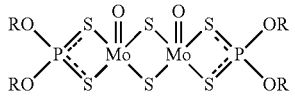

wherein R is a linear or branched alkyl group comprising 1 to 20 carbon atoms, or from about 1 to 18 carbon atoms, or from about 1 to about 16 carbon atoms, or 2 to 12 carbon atoms, or about 3 to about 8 carbon atoms, and including moieties such as alkyl and cycloalkyl moieties, and each R group may be the same or different. These groups may be, for example, ethyl, n-propyl, i-propyl, n-butyl, i-butyl, sec-butyl, amyl, n-hexyl, i-hexyl, 4-methyl-pentyl, n-octyl, decyl, dodecyl, undecyl, dodecyl, tridecyl, tetradecyl, pentadecyl, hexadecyl, heptadecyl, octadecyl, 2-ethylhexyl, nonadecyl, eicosyl, 2-ethylhexyl, cyclohexyl, or methylcyclopentyl.

The organomolybdenum complexes of the present invention include molybdenum succinimide complexes or organomolybdenum complexes of organic amides, and mixtures thereof. Suitable molybdenum-succinimide complexes are described, for example, in U.S. Pat. No. 8,076,275, incorporated herein by reference. These complexes are prepared by a process comprising reacting an acidic molybdenum compound with an alkyl or alkenyl succinimide of a polyamine. For example, the organomolybdenum complex may be prepared by reacting coco monoglyceride and a molybdenum oxide.

Suitable examples of molybdenum compounds which may be used include commercial materials sold under the trade names such as Molyvan 822™, Molyvan™ A, Molyvan™ L, Molyvan® 807 NT, Molyvan® 822 NT, Molyvan® 3000, Molyvan® 855, Molyvan 2000™ and Molyvan 855™ from R. T. Vanderbilt Co., Ltd., and Sakura-Lube™ S-165, S-200, S-300, S-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula $Mo_3S_kL_nQ_z$ and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values.

Typically, to provide oil solubility, the organo-molybdenum compounds will contain at least 21 total carbon atoms in the organo groups of the ligands. These organo-molybdenum compounds may contain at least 25 total carbon atoms, at least 30 total carbon atoms, or at least 35 total carbon atoms.

Additional suitable molybdenum compounds are described in U.S. Pat. No. 6,723,685, herein incorporated by reference in its entirety.

The oil-soluble molybdenum compound may be present in the transmission fluid an amount of from about 0.005 wt. % to about 5.0 wt. %, or from about 0.0075 wt. % to about 3.0 wt. %, or from about 0.01 to about 2.5 wt. %, or from about 0.015 wt. % to about 1.0 wt. %, based on total weight of the transmission fluid composition.

The oil-soluble molybdenum compound may be employed in the transmission fluid in an amount sufficient to provide about 5 ppm to less than about 500 ppm, about 10 ppm to about 300 ppm, about 25 ppm to about 240 ppm, about 30 ppm to less than about 240 ppm of molybdenum, about 30 ppm to about 200 ppm of molybdenum, or from about 30 ppm to about 120 ppm of molybdenum to the transmission fluid composition, based on the total weight of the transmission fluid composition. Excessive amounts of molybdenum may produce transmission fluids that are too slippery, and thus, not sufficient to generate or transfer power.

Zinc Dialkyl Dithiophosphate Compound(s)

The transmission fluid composition of the disclosure for use in an internal combustion engine to improve viscosity control contains an amount of one or more zinc dialkyl dithiophosphates (ZDDP compounds). The one or more ZDDP compounds can improve friction and wear properties of the transmission fluid composition.

The one or more ZDDP compounds can be present in the transmission fluid composition in amounts of from about 0.01 wt. % to about 15 wt. %, or about 0.01 wt. % to about 10 wt. %, or about 0.05 wt. % to about 5 wt. %, or about 0.1 wt. % to about 3 wt. % based on the total weight of the transmission fluid composition.

The one or more ZDDP compounds can comprise ZDDP compounds derived from primary alkyl alcohols, secondary alkyl alcohols, or a combination of primary and secondary alkyl alcohols. The primary alkyl alcohols and secondary alkyl alcohols used to prepare the one or more ZDDP compounds may have an alkyl group including 1 to 20 carbon atoms, or from about 1 to about 18 carbon atoms, or from about 1 to about 16 carbon atoms, or about 2 to about 12 carbon atoms, or about 3 to about 10 carbon atoms. Preferably, the primary alkyl alcohols have branching at the beta carbon relative to the hydroxyl group. An alcohol with branching at the beta (β) carbon, would be branching at the second carbon counted from the oxygen atom of the hydroxyl group, e.g.:

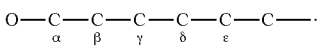

Suitable examples of primary and secondary alkyl alcohols for use in preparing the one or more ZDDP compounds include n-propyl alcohol, isopropyl alcohol, n-butyl alcohol, 2-butanol, isobutyl alcohol, n-pentyl alcohol, amyl alcohol, hexanol, methyl isobutyl carbinol, isohexanol, n-heptanol, isoheptanol, octanol, nonanol, decanol, undecanol, dodecanol, tridecanol, tetradecanol, pentadecanol, hexadecanol, heptadecanol, octadecanol, nonadecanol, eicosanol, and 2-ethylhexanol.

The molar ratio of primary alkyl alcohol to secondary alkyl alcohol used to make the one or more ZDDP compounds in the transmission fluid composition can be from about 100:0 to 0:100, or from about 100:0 to 50:50, or from 100:0 to 60:40. The one or more ZDDP compounds may have a Zn:P molar ratio of from about 1.08 to 1.3, or from about 1.08 to 1.2, or from about 1.09 to about 1.15. In some embodiments, the one or more one or more ZDDP compounds may be overbased with zinc oxide.

In some embodiments, 100 mole percent of the alkyl groups of the one or more one or more ZDDP compounds may be derived from one or more primary alcohol groups.

The alcohols suitable for producing the one or more ZDDP compounds may be primary alkyl alcohols, secondary alkyl alcohols, or a mixture of primary and secondary alcohols. In an embodiment, the additive package comprises one ZDDP compound derived from an alcohol comprising a primary alkyl group and another ZDDP compound derived from an alcohol comprising a secondary alkyl group. In another embodiment, the ZDDP compound is derived from at least two secondary alcohols. The alcohols may contain any of branched, cyclic, or straight carbon chains.

The one or more ZDDP compounds may be oil soluble salts of dihydrocarbyl dithiophosphoric acids and may be represented by the following formula:

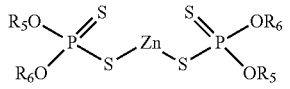

wherein $R_5$ and $R_6$ may be the same or different alkyl groups containing from 1 to 20 carbon atoms, or from about 1 to 18 carbon atoms, or from about 1 to about 16 carbon atoms, or about 2 to about 12 carbon atoms, or about 3 to about 8 carbon atoms, and including moieties such as alkyl, and cycloalkyl moieties. Thus, the moieties may, for example, be ethyl, n-propyl, i-propyl, n-butyl, i-butyl, sec-butyl, amyl, n-hexyl, i-hexyl, 4-methyl-pentyl, n-octyl, decyl, dodecyl, undecyl, dodecyl, tridecyl, tetradecyl, pentadecyl, hexadecyl, heptadecyl, octadecyl, 2-ethylhexyl, nonadecyl, eicosyl, 2-ethylhexyl, cyclohexyl, or methylcyclopentyl.

The average total number of carbon atoms per mole of phosphorus for a ZDDP compound may be calculated by dividing the sum of the carbon atoms in the four alkyl groups $R_5$ and $R_6$ by two. For example, for a single ZDDP compound, if $R_5$ is a $C_3$-alkyl group and $R_6$ is a $C_6$ alkyl group, the total number of carbon atoms is 3+3+6+6=18. Dividing this by two moles of phosphorus per mole of ZDDP gives an average total number of carbon atoms per mole of phosphorus of 9. The average total number of carbon atoms per mole of phosphorus (ATCP) for compositions containing one or more ZDDP compounds may be calculated from the alcohol(s) used to make the ZDDP compounds according to the following formula:

ATCP=2*[(mol % of alc1*# of C atoms in alc1)+ (mol % of alc2*# of C atoms in alc2)+(mol % of alc3*# of C atoms in alc3)+ . . . etc.]

wherein alc1, alc2 and alc3 each represent a different alcohol used to make the ZDDP compound(s) and the mol % is the molar percentage of each of the alcohols that was present in the reaction mixture used to make the ZDDP compound(s). The "etc." indicates that if more than three alcohols are used to make the ZDDP compounds(s), the formula can be expanded to include each of the alcohols present in the reaction mixture.

The average total number of carbon atoms from both $R_5$ and $R_6$ in the ZDDP is greater than 2 carbon atoms per mole of phosphorus, and in one embodiment is in a range of from greater than 4 to 40 carbon atoms, or from greater than 6 to about 20 carbon atoms, or from greater than 6 to about 16 carbon atoms, or from about 6 to about 15 carbon atoms, or from about 9 to about 15 carbon atoms, or about 12 carbon atoms, per mole of phosphorus.

The zinc dialkyl dithiophosphate compounds may be prepared in accordance with known techniques by first forming a dialkyl dithiophosphoric acid (DDPA), usually by reaction of one or more alcohols and then neutralizing the formed DDPA with a zinc compound. To make the zinc compound, any basic or neutral zinc compound could be used but the oxides, hydroxides, and carbonates are usually employed. The zinc dialkyl dithiophosphates of component (i) may be made by a process such as the process described in U.S. Pat. No. 7,368,596.

In some embodiments, the one or more ZDDP compounds may be present in the transmission fluid in an amount sufficient to provide from about 100 to about 1500 ppm phosphorus, or from about 200 to about 1300 ppm phosphorus, or from about 300 to about 1200 ppm phosphorus, or from about 550 to about 1200 ppm phosphorus, based on the total weight of the transmission fluid composition.

In some embodiments, the one or more ZDDP compounds may be present in the transmission fluid composition in an amount sufficient to provide from about 700 ppmw zinc to about 1500 ppmw zinc, or from about 750 ppmw zinc to about 1400 ppmw zinc, or from about 800 ppmw zinc to about 1300 ppmw zinc, or from about 850 ppm to about 1200 ppmw of zinc to the transmission fluid composition, based on the total weight of the transmission fluid composition.

The present invention can include overbased ZDDP's which are basic ZDDP's. The term basic ZDDP's or equivalent expressions, is used herein to describe those zinc salts wherein the metal substituent is present in stoichiometrically greater amounts than the phosphorus acid radical. For instance, normal or neutral zinc phosphorodithioate has two equivalents (i.e., 1 mole) of zinc per two equivalents (i.e., 2 moles) of a phosphorodithioic acid, whereas a basic zinc diorganophosphorodithioate has more than two equivalents of zinc per two equivalents of the phosphorodithioic acid.

For instance, the overbasing can be performed with a basic zinc compound such as zinc oxide. The amount of basic zinc compound required to give the desired overbasing is not critical. The essential factor is that there be present in the reaction mixture sufficient zinc compound for the overbasing reaction. Although it is not absolutely essential, it has been found that the reaction proceeds in a more satisfactory way if a slight excess of zinc compound over the amount required for reaction is used. This excess should be kept at a minimum level to the necessity for removing large amounts of solid from the final product. As a general statement, the excess of zinc compound should not exceed 10-15 percent by weight.

Detergents

The transmission fluid composition may include one or more neutral, low based, or overbased detergents, and mixtures thereof. Suitable detergents and their methods of preparation are described in greater detail in numerous patent publications, including U.S. Pat. No. 7,732,390 and references cited therein. For example, the one or more detergents may be an overbased calcium sulfonate detergent.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or dithiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the transmission fluid composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater, as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or dithiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

For example, the calcium sulfonate detergent may be an overbased calcium sulfonate detergent having a total base number (TBN) of about 200 mg KOH/g or greater, or about 250 mg KOH/g or greater, or about 300 mg KOH/g or greater, or about 350 mg KOH/g or greater, or about 375 mg KOH/g or greater, or about 400 mg KOH/g or greater, as measured by the method of ASTM D-2896.

The calcium sulfonate detergent may be present in an amount to provide of from about 2000 ppmw of calcium to about 5000 ppmw of calcium, or from about 2250 ppmw of calcium to about 4500 ppmw of calcium, or from about 2500 ppmw of calcium to about 4000 ppmw of calcium, or from about 2750 ppmw of calcium to about 3750 ppmw of calcium to the transmission fluid composition, based on the total weight of the transmission fluid composition.

The calcium sulfonate detergent may have a metal to substrate ratio of from 1.1:1, or from 2:1, or from 4:1, or from 5:1, or from 7:1, or from 10:1, or greater.

In some embodiments, the calcium sulfonate detergent may comprise a branched alkyl group.

In some embodiments, a detergent is effective at reducing or preventing rust in an engine.

The detergent may be present at about 0 wt. % to about 10 wt. %, or about 0.1 wt. % to about 8 wt. %, or about 1 wt. % to about 4 wt. %, or greater than about 4 wt. % to about 8 wt. %.

Dispersants

The transmission fluid composition may optionally further comprise one or more dispersants or mixtures thereof. Dispersants are often known as ashless-type dispersants because, prior to mixing in a transmission fluid composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with number average molecular weight of the polyisobutylene substituent in the range about 350 to about 50,000, or to about 5,000, or to about 3,000, as measured by GPC. Succinimide dispersants and their preparation are disclosed, for instance in U.S. Pat. No. 7,897,696 or U.S. Pat. No. 4,234,435. The alkenyl substituent may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

In some approaches, suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, or from about 500 to about 2000, or from about 750 to about 1800, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000, as determined by GPC, may be suitable. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment, the present disclosure further comprises at least one dispersant derived from polyisobutylene succinic anhydride ("PIBSA"). The PIBSA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

The hydrocarbyl moiety of the hydrocarbyl-dicarboxylic acid or anhydride of Component A) may alternatively be derived from ethylene-alpha olefin copolymers. These copolymers contain a plurality of ethylene units and a plurality of one or more $C_3$-$C_{10}$ alpha-olefin units. The $C_3$-$C_{10}$ alpha-olefin units may include propylene units.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with:

Inorganic phosphorous acids or anhydrates (e.g., U.S. Pat. Nos. 3,403,102 and 4,648,980);

Organic phosphorous compounds (e.g., U.S. Pat. No. 3,502,677);

Phosphorous pentasulfides;

Boron compounds as already noted above (e.g., U.S. Pat. Nos. 3,178,663 and 4,652,387);

Carboxylic acid, polycarboxylic acids, anhydrides and/or acid halides (e.g., U.S. Pat. Nos. 3,708,522 and 4,948,386);

Epoxides polyepoxiates or thioexpoxides (e.g., U.S. Pat. Nos. 3,859,318 and 5,026,495);

Aldehyde or ketone (e.g., U.S. Pat. No. 3,458,530);

Carbon disulfide (e.g., U.S. Pat. No. 3,256,185);

Glycidol (e.g., U.S. Pat. No. 4,617,137);

Urea, thourea or guanidine (e.g., U.S. Pat. Nos. 3,312,619; 3,865,813; and British Patent GB 1,065,595);

Organic sulfonic acid (e.g., U.S. Pat. No. 3,189,544 and British Patent GB 2,140,811);

Alkenyl cyanide (e.g., U.S. Pat. Nos. 3,278,550 and 3,366,569);

Diketene (e.g., U.S. Pat. No. 3,546,243);

A diisocyanate (e.g., U.S. Pat. No. 3,573,205);

Alkane sultone (e.g., U.S. Pat. No. 3,749,695);

1,3-Dicarbonyl Compound (e.g., U.S. Pat. No. 4,579,675);

Sulfate of alkoxylated alcohol or phenol (e.g., U.S. Pat. No. 3,954,639);

Cyclic lactone (e.g., U.S. Pat. Nos. 4,617,138; 4,645,515; 4,668,246; 4,963,275; and 4,971,711);

Cyclic carbonate or thiocarbonate linear monocarbonate or polycarbonate, or chloroformate (e.g., U.S. Pat. Nos. 4,612,132; 4,647,390; 4,648,886; 4,670,170);

Nitrogen-containing carboxylic acid (e.g., U.S. Pat. No. 4,971,598 and British Patent GB 2,140,811);

Hydroxy-protected chlorodicarbonyloxy compound (e.g., U.S. Pat. No. 4,614,522);

Lactam, thiolactam, thiolactone or ditholactone (e.g., U.S. Pat. Nos. 4,614,603 and 4,666,460);

Cyclic carbonate or thiocarbonate, linear monocarbonate or plycarbonate, or chloroformate (e.g., U.S. Pat. Nos. 4,612,132; 4,647,390; 4,646,860; and 4,670,170);

Nitrogen-containing carboxylic acid (e.g., U.S. Pat. No. 4,971,598 and British Patent GB 2,440,811);

Hydroxy-protected chlorodicarbonyloxy compound (e.g., U.S. Pat. No. 4,614,522);

Lactam, thiolactam, thiolactone or dithiolactone (e.g., U.S. Pat. Nos. 4,614,603, and 4,666,460);

Cyclic carbamate, cyclic thiocarbamate or cyclic dithiocarbamate (e.g., U.S. Pat. Nos. 4,663,062 and 4,666,459);

Hydroxyaliphatic carboxylic acid (e.g., U.S. Pat. Nos. 4,482,464; 4,521,318; 4,713,189); Oxidizing agent (e.g., U.S. Pat. No. 4,379,064);

Combination of phosphorus pentasulfide and a polyalkylene polyamine (e.g., U.S. Pat. No. 3,185,647);

Combination of carboxylic acid or an aldehyde or ketone and sulfur or sulfur chloride (e.g., U.S. Pat. Nos. 3,390,086; 3,470,098);

Combination of a hydrazine and carbon disulfide (e.g. U.S. Pat. No. 3,519,564);

Combination of an aldehyde and a phenol (e.g., U.S. Pat. Nos. 3,649,229; 5,030,249; 5,039,307);

Combination of an aldehyde and an O-diester of dithiophosphoric acid (e.g., U.S. Pat. No. 3,865,740);

Combination of a hydroxyaliphatic carboxylic acid and a boric acid (e.g., U.S. Pat. No. 4,554,086);

Combination of a hydroxyaliphatic carboxylic acid, then formaldehyde and a phenol (e.g., U.S. Pat. No. 4,636,322);
Combination of a hydroxyaliphatic carboxylic acid and then an aliphatic dicarboxylic acid (e.g., U.S. Pat. No. 4,663,064);
Combination of formaldehyde and a phenol and then glycolic acid (e.g., U.S. Pat. No. 4,699,724);
Combination of a hydroxyaliphatic carboxylic acid or oxalic acid and then a diisocyanate (e.g. U.S. Pat. No. 4,713,191);
Combination of inorganic acid or anhydride of phosphorus or a partial or total sulfur analog thereof and a boron compound (e.g., U.S. Pat. No. 4,857,214);
Combination of an organic diacid then an unsaturated fatty acid and then a nitrosoaromatic amine optionally followed by a boron compound and then a glycolating agent (e.g., U.S. Pat. No. 4,973,412);
Combination of an aldehyde and a triazole (e.g., U.S. Pat. No. 4,963,278);
Combination of an aldehyde and a triazole then a boron compound (e.g., U.S. Pat. No. 4,981,492);
Combination of cyclic lactone and a boron compound (e.g., U.S. Pat. Nos. 4,963,275 and 4,971,711). The above mentioned patents are herein incorporated in their entireties.

The TBN of a suitable dispersant may be from about 10 to about 65 on an oil-free basis, which is comparable to about 5 to about 30 TBN if measured on a dispersant sample containing about 50% diluent oil. TBN is measured by the method of ASTM D2896.

The dispersant, if present, can be present at about 20 wt. %, or from about 0.1 wt. % to about 15 wt. %, or about 0.1 wt. % to about 10 wt. %, or about 0.1 to about 8 wt. %, or about 1 wt. % to about 10 wt. %, or about 1 wt. % to about 8 wt. %, or about 1 wt. % to about 6 wt. %, based upon the total weight of the transmission fluid composition.

The dispersant, if present, may be present in an amount to contribute 5 ppm nitrogen to about 1000 ppm of nitrogen, or from about 10 ppm nitrogen to about 500 ppm nitrogen, or from about 25 ppm of nitrogen to about 200 ppm of nitrogen to the transmission fluid.

In some embodiments, the transmission fluid composition utilizes a mixed dispersant system. A single type or a mixture of two or more types of dispersants in any desired ratio may be used.

Other Optional Components

The transmission fluid composition described herein may also include conventional additives of the type used in automatic transmission fluid compositions in addition to the components described above. Such additives include, but are not limited to, dispersant additives, detergent additives, antioxidants, corrosion inhibitors, antirust additives, metal deactivators, antifoamants, pour point depressants, air entrainment additives, seal swell agents, and the like.

Antioxidants

The transmission fluid compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the transmission fluid composition may contain a mixture of a diarylamine and a high molecular weight phenol, such that each antioxidant may be present in an amount sufficient to provide up to about 5%, by weight, based upon the total weight of the transmission fluid composition. In an embodiment, the antioxidant may be a mixture of about 0.3 to about 1.5% diarylamine and about 0.2 to about 2.5% high molecular weight phenol, by weight, based upon the total weight of the transmission fluid composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as $\alpha$-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt. % to about 20 wt. %, or about 0.1 wt. % to about 10 wt. %, or about 1 wt. % to about 5 wt. %, of the transmission fluid composition.

Corrosion Inhibitors

Rust or corrosion inhibitors may also be included in the transmission fluids described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Mixtures of such rust or corrosion inhibitors may be used. The total amount of corrosion inhibitor, when present in the compositions described herein may range up to 5.0 wt. % or from 0.01 to 2.0 wt. % based on the total weight of the composition.

Seal Swell Agents

The transmission fluid composition described herein may optionally contain seal swell agents such as alcohols, alkylbenzenes, substituted sulfolanes or mineral oils that cause swelling of elastomeric materials. Alcohol-type seal swell agents are low volatility linear alkyl alcohols. Examples of suitable alcohols include decyl alcohol, tridecyl alcohol and tetradecyl alcohol. Examples of alkylbenzenes useful as seal swell agents for use in conjunction with the compositions described herein include dodecylbenzenes, tetradecylbenzenes, dinonyl-benzenes, di(2-ethylhexyl)benzene, and the like. Examples of substituted sulfolanes are described in U.S. Pat. No. 4,029,588, incorporated herein by reference. Mineral oils useful as seal swell agents are typically low viscosity mineral oils with high naphthenic or aromatic content. When used in the transmission fluid composition described herein, a seal swell agent will comprise from 1 to 30 wt. %, preferably from 2 to 20 wt. %, most preferably from 5 to 15 wt. %, based on the total weight of the transmission fluid composition.

Friction Modifiers

Another component that can be added to the transmission fluid composition is a friction modifier. Friction modifiers are used in the transmission fluid compositions as described herein to decrease or increase friction between surfaces (e.g., the members of a torque converter clutch or a shifting clutch) at low sliding speeds. Typically, the desired result is a friction-vs.-velocity (μ-v) curve that has a positive slope, which in turn leads to smooth clutch engagements minimizing "stick-slip" behavior (e.g., shudder, noise, and harsh shifts).

Friction modifiers include such compounds as aliphatic amines or ethoxylated aliphatic amines, ether amines, alkoxylated ether amines, sarcosine compounds, aliphatic fatty acid amides, acylated amines, aliphatic carboxylic acids, aliphatic carboxylic esters, polyol esters, aliphatic carboxylic ester-amides, imidazolines, tertiary amines, aliphatic phosphonates, aliphatic phosphates, aliphatic thiophosphonates, aliphatic thiophosphates, etc., wherein the aliphatic group usually contains one or more carbon atoms so as to render the compound suitably oil soluble. As a further example, the aliphatic group may contain 8 or more carbon atoms. Also suitable are aliphatic substituted succinimides formed by reacting one or more aliphatic succinic acids or anhydrides with ammonia primary amines.

The friction modifier is desirably present in the transmission fluid composition in an amount that is sufficient to provide from 50 to 800 ppm, and desirably from 150 to 500 ppm by weight nitrogen to the transmission fluid composition based on a total weight of the transmission fluid composition.

Other friction modifier compounds may also be included in the transmission fluid compositions described herein. For example, one group of friction modifiers includes the N-aliphatic hydrocarbyl-substituted diethanol amines in which the N-aliphatic hydrocarbyl-substituent is at least one straight chain aliphatic hydrocarbyl group free of acetylenic unsaturation and having in the range of 14 to 20 carbon atoms.

Another friction modifier that may be used is based on a combination of (i) at least one di(hydroxyalkyl) aliphatic tertiary amine in which the hydroxyalkyl groups, being the same or different, each contain from 2 to 4 carbon atoms, and in which the aliphatic group is an acyclic hydrocarbyl group containing from 10 to 25 carbon atoms, and (ii) at least one hydroxyalkyl aliphatic imidazoline in which the hydroxyalkyl group contains from 2 to 4 carbon atoms, and in which the aliphatic group is an acyclic hydrocarbyl group containing from 10 to 25 carbon atoms. For further details concerning this friction modifier system, reference should be made to U.S. Pat. No. 5,344,579.

Generally speaking, the transmission fluid composition described herein may suitably contain up to 2.5 wt. %, desirably from 0.05 wt. % to 2.2 wt. %, and preferably up to 1.8 wt. %, or up to only 1.25 wt. %, or, as a further example, most preferably from 0.75 to 1 wt. % of one or more total friction modifiers in the transmission fluid composition.

Extreme Pressure Agent(s)

The transmission fluid compositions may optionally contain one or more extreme pressure agents. Extreme Pressure agents that are soluble in the oil include sulfur- and chlorosulfur-containing extreme pressure agents, chlorinated hydrocarbon EP agents and phosphorus EP agents. Examples of such EP agents include chlorinated waxes; organic sulfides and polysulfides such as sulfurized polyisobutylene, sulfurized fatty acids, dibenzyldisulfide, bis (chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof. Preferred extreme pressure agents are sulfurized polyisobutylene and sulfurized fatty acids.

The extreme pressure agent, when present in the transmission fluid composition may be present in amount up to 10 wt. % or the lubricant composition may contain from 0.001 to 2 wt. %, preferably from 0.01 to 0.3 wt. %, more preferably from 0.02 to 0.15 wt. %, most preferably from 0.03 to 0.1 wt. % of extreme pressure agents based on the total weight of the transmission fluid composition.

Anti-Foam Agents

In some embodiments, a foam inhibitor may form another component suitable for use in the transmission fluid compositions described herein. Foam inhibitors may be selected from silicones, polyacrylates, and the like. When present, the amount of antifoam agent in the transmission fluid compositions described herein may range up to 1.0 wt. %, or from 0.001 wt. % to 0.1 wt. % based on the total weight of the transmission fluid composition. As a further example, antifoam agent may be present in a preferred amount of from 0.004 wt. % to 0.10 wt. %.

Viscosity Index Improvers

The transmission fluid composition may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 2012/0101017 A1.

The transmission fluid composition herein also may optionally contain one or more dispersant viscosity index improvers in addition to a viscosity index improver or in lieu of a viscosity index improver. Suitable dispersant viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver, when present, may be up to 30 wt. %, or may be from 0.001 wt. % to 25 wt. %, or 0.01 wt. % to 20 wt. %, or 0.1 wt. % to 15 wt. %, or 0.1 wt. % to 8 wt. %, or 0.5 wt. % to 5 wt. % based on the total weight of the transmission fluid composition.

Pour Point Depressants

The transmission fluid composition may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from 0.001 wt. % to 1 wt. %, or 0.01 wt. % to 0.5 wt. %, or 0.02 wt. % to 0.04 wt. %, based upon the total weight of the lubricant composition.

In one embodiment the lubricant composition may comprise one or more demulsifying agents, such as trialkyl phosphates, polyethylene glycols, polyethylene oxides, polypropylene oxides and (ethylene oxide-propylene oxide) polymers.

Additives used in formulating the transmission fluid compositions described herein can be blended into the base oil individually or in various sub-combinations. However, it is suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

In general terms, a suitable transmission fluid composition may include additive components in the ranges listed in the following Table 2:

TABLE 2

| Component | Wt. % (Suitable Embodiments) | Wt. % (Preferred Embodiments) |
|---|---|---|
| Molybdenum - Containing Compound | 0.1-10.0 | 0.5-5.0 |
| Zinc Dihydrocarbyl Dithiophosphate | 0.01-5.0 | 0.05-2.0 |
| Dispersant(s) | 0.5-20.0 | 1.0-15.0 |
| Antioxidant(s) | 0-2.0 | 0.01-1.0 |
| Metal Detergent(s) | 0.1-10.0 | 0.5-5.0 |
| Corrosion inhibitor(s) | 0.0-5.0 | 0.1-2.0 |
| Extreme Pressure/Antiwear Agent(s) | 0.0001-10 | 0.01-2.0 |
| Antifoaming agent(s) | 0.0-1.0 | 0.001-0.1 |
| Friction Modifier(s) | 0-2.0 | 0.05-1.0 |
| Viscosity index improver(s) | 0.0-30.0 | 0.1-8 |
| Pour point depressant(s) | 0.001-1.0 | 0.01-0.5 |
| Seal swell agent(s) | 0-10.0 | 0.5-5.0 |
| Base oil(s) | Balance | Balance |
| Total | 100 | 100 |

The percentages of each component above represent the weight percent of each component, based upon the total weight of the final transmission fluid composition containing the recited component. The remainder of the transmission fluid composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

The lubricant compositions disclosed herein may be transmission fluids, driveline oils, gear oils or axle lubricants.

Also disclosed herein are methods for reducing gear scuffing in a transmission or gear including a step of lubricating the transmission or gear with the transmission fluid composition described above. Also within the scope of this disclosure are methods of operating a transmission including steps of lubricating said transmission with the transmission fluid composition described herein and operating the transmission.

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

A series of tests were carried out to determine the impact of varying the molybdenum concentrations and the types of molybdenum-containing compounds on friction and bearing pitting performance.

The following examples employed the same compositions, except for the amount and type of molybdenum-containing compound, and the amount and type of overbased calcium sulfonate detergent. Tables 4 and 5 indicate the molybdenum-containing compound included in each example and the amount of molybdenum contributed to the transmission fluid composition by that molybdenum-containing compounds. The formulations of Table 4 included a mixture of linear and branched overbased calcium sulfonate detergents in an amount to provide about 3264 ppm Ca to the transmission fluid composition. The Examples in Table 5 included a branched overbased calcium sulfonate detergent present in an amount to provide about 3422 ppm Ca to the transmission fluid composition.

In addition, each of the working examples included a DI package comprising one or more antioxidants, one or more corrosion inhibitors, and one or more seal swell agents, as set forth in Table 3. The major amount of base oil was a mixture of Group I base oils. All of the values are stated as weight percent of the component in the transmission fluid composition (i.e., active ingredient plus diluent oi, if any) unless specified otherwise.

TABLE 3

| DI Package Composition Ranges | |
|---|---|
| Component | Wt. % |
| Antioxidant(s) | 0.1 to 2.5 |
| Seal Swell Agent(s) | 0.01 to 0.5 |
| Corrosion Inhibitor(s) | 0.01 to 0.15 |

The formulations in Table 4 were subjected to the ZF bearing pitting test, No. 0000 702 232. The ZF test consists of FE-8 cylinder roller thrust bearings operated at a fluid temperature of 100° C. The bearings are rotated at 300 rpm until sufficient wear occurs to cause excessive vibration, at which time the test is stopped. The "hours to failure" indicate the running time until excessive vibration occurred. Hours to failure in excess of 750 hours indicates a passing lubricant composition and hours to failure below 750 hours indicates a failing lubricant composition.

TABLE 4

| Example | Type of Mo-containing Compound | Mo ppm, from Mo-containing compound | Bearing Pitting Test (>750 hours) |
|---|---|---|---|
| Example 1 | Moly Amide/Ester Complex | 120 | Passed |
| Example 2 | Moly Amide/Ester Complex | 60 | Passed |
| Example 3 | Moly Amide/Ester Complex | 30 | Passed |
| Example 4 | Moly Dithiocarbamate | 120 | Passed |
| Example 5 | Moly Dithiocarbamate | 30 | Passed |
| Example 6 | Moly Dialkyldithiophosphate | 30 | Passed |
| Example 7 | Moly Amide/Ester Complex | 240 | Passed |
| Comparative Example 1 | N/A | 0 | Fail |

The formulations in Table 5 were subjected to a Caterpillar TO-4 SEQ 1221 Friction Test to test static friction. This test utilizes the Link Model 1158 Oil/Friction Test Machine which is an inertia dynamometer in which the kinetic energy of a freely rotating mass is absorbed by the reaction of a rotating friction disc and an opposing stationary steel plate. A flywheel is accelerated to predetermined speeds and brought to a stop by bringing the disc and plate together at various engagement pressures.

TABLE 5

| Example | Type of Mo-containing Compound | Mo ppm, from Mo-containing compound | Static Friction, SEQ 1221 |
|---|---|---|---|
| Control 1 | N/A | 0 | Passed |
| Example 8 | Moly Amide/Ester Complex | 120 | Passed |
| Comparative Example 2 | Moly Amide/Ester Complex | 240 | Failed |

The examples of table 5 demonstrate that the inclusion of a molybdenum-containing compound in varying concentrations provided passing static friction test results. Also, the examples of Table 5 demonstrate that different types of molybdenum-containing compounds are suitable for passing the bearing pitting test.

Comparative Example 1 is the only example which failed the bearing pitting test. and the only difference between the formulation of Comparative Example 1 and Examples 1-7 was the absence of the molybdenum-containing compound. Furthermore, Examples 3, 5, and 6 each passed the bearing pitting test with molybdenum concentrations of 30 ppm, and these examples included a molybdenum amide ester complex, a molybdenum dithiocarbamate, and a molybdenum dialkyldithiophosphate, respectively. Similarly, Examples 1 and 4 each passed the bearing pitting test with molybdenum concentrations of 120 ppm, and these examples included a molybdenum amide ester complex and a molybdenum dithiocarbamate, respectively. These examples demonstrate that various molybdenum-containing compounds are effective at improving performance in the bearing pitting test at concentrations of from 30 ppm to less than 240 ppm of molybdenum, based on the total weight of the formulation.

The data in table 5 demonstrates the ability of the formulations to pass the static friction test, as measured by Caterpillar TO-4 SEQ 1221. Control 1 demonstrates that the presence of the molybdenum-containing compound is not necessary to pass the static friction test. However, Example 8 shows that a fluid having a concentration of 120 ppm of molybdenum still passed the friction test, whereas Comparative Example 2, shows that a fluid with a higher concentration of 240 ppm of molybdenum did not meet the requirements of the Caterpillar TO-4 SEQ 1221 test.

Based on the results of Tables 4 and 5, a connection can be made between Control 1 and Comparative Example 1, Example 1 and Example 8, and Example 7 and Comparative Example 2. Each of these three sets of examples have essentially the same formulation, except for small variations in the concentration of the calcium sulfonate detergent.

Although Control 1 passed the friction test, corresponding Comparative Example 1 did not pass the bearing pitting test. Example 8 passed the friction test and corresponding Example 1 passed the bearing pitting test. Lastly, Comparative Example 2 failed the friction test and corresponding Example 7 passed the bearing pitting test. These results show that formulations having a molybdenum-containing compound present in an amount to provide less than 240 ppm molybdenum but greater than 30 ppm molybdenum to the fluid composition can be expected to provide improved bearing pitting performance while still being able to pass the static friction test of the Caterpillar TO-4 specification.

Other embodiments of the present disclosure will be apparent to those skilled in the art from consideration of the specification and practice of the embodiments disclosed herein. As used throughout the specification and claims, "a"

and/or "an" and/or "the" may refer to one or more than one. Unless otherwise indicated, all numbers expressing quantities, proportions, percentages, or other numerical values are to be understood as being modified in all instances by the term "about." Accordingly, unless indicated to the contrary, the numerical parameters set forth in the specification and claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1-4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A method for passing the ZF bearing pitting test, No. 0000 702 232 and passing static friction performance according to Caterpillar TO-4 SEQ 1221 in a transmission for off-road vehicles and/or heavy machinery, comprising lubricating the transmission with a transmission fluid composition comprising:

greater than 50 wt. % of a base oil of lubricating viscosity;

a detergent composition comprising one or more branched overbased calcium sulfonate detergent(s), wherein the one or more branched overbased calcium sulfonate detergent(s) is in an amount to provide from about 2000 ppm to about 5000 ppm of calcium to the transmission fluid composition; and an amount of one or more zinc dialkyl dithiophosphate compound(s) to provide from about 700 ppm to about 1500 ppm of zinc to the transmission fluid composition;

an amount of one or more molybdenum-containing compound(s) to provide from 30 ppmw to 200 ppmw molybdenum to the transmission fluid composition, wherein all amounts are based on a total weight of the transmission fluid composition and the one or more molybdenum-containing compound(s) is selected from the group consisting of molybdenum dithiocarbamate, molybdenum phosphorodithioate, organomolybdenum complex, and molybdenum dialkyldithiophosphate.

2. The method of claim 1, wherein the one or more molybdenum-containing compound(s) is present in an amount to provide from 30 ppmw to 120 ppmw molybdenum to the transmission fluid composition, based on the total weight of the transmission fluid composition.

3. The method of claim 1, wherein the one or more zinc dialkyl dithiophosphate compound(s) is derived from one or more primary alkyl alcohol(s) each having an alkyl group with 3 to 10 carbon atoms.

4. The method of claim 3, wherein the alkyl group of the one or more primary alkyl alcohol(s) has branching at the beta carbon relative to the hydroxyl group.

5. The method of claim 1, wherein the one or more zinc dialkyl dithiophosphate compound(s) is present in an amount to provide from about 750 ppm to about 1400 ppm of zinc to the transmission fluid composition, based on the total weight of the transmission fluid composition.

6. The method of claim 1, wherein the one or more branched overbased calcium sulfonate detergent(s) has a total base number (TBN) of about 200 mg KOH/g or greater, as measured by the method of ASTM D-2896.

7. The method of claim 1, wherein the molybdenum-containing compound(s) are selected from molybdenum dithiocarbamates of the formula:

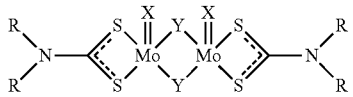

wherein Y and X are independently selected from oxygen and sulfur, each X and each Y may be the same or different, and R is selected from a linear or branched alkyl group having 1 to 30 carbon atoms;

molybdenum dialkyl phosphorodithioates of the formula:

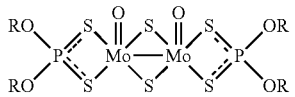

wherein R is a linear or branched alkyl group having 1 to 30 carbon atoms or R is an alkenyl group having 2 to 30 carbon atoms, and each R group may be the same or different;

molybdenum dialkyldithiophosphates of the formula:

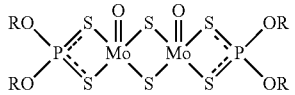

wherein R is a linear or branched alkyl group having 1 to 20 carbon atoms, and each R group may be the same or different;

molybdenum succinimide complexes or organomolybdenum complexes of organic amides; and mixtures of any two or more of the foregoing molybdenum compounds and complexes.

8. The method of claim 1, further comprising an amount of one or more dispersant(s), to provide from about 10 ppm to about 200 ppm of nitrogen to the transmission fluid composition, based on the total weight of the transmission fluid composition.

9. The method of claim 8, wherein the one or more dispersant(s) comprises a succinimide dispersant.

10. The method of claim 8, wherein the dispersant is present in an amount of less than 5.0 wt. %, based on the total weight of the transmission fluid composition.

* * * * *